US011162677B2

(12) United States Patent
Beakley et al.

(10) Patent No.: US 11,162,677 B2
(45) Date of Patent: Nov. 2, 2021

(54) AIR INTAKE COUPLING WITH NOISE SUPPRESSION FOR LOW NOX EMISSION FURNACE

(71) Applicant: Lennox Industries Inc., Richardson, TX (US)

(72) Inventors: Leonor Beakley, Plano, TX (US); Darcy Q. Easterling, Flower Mound, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 16/251,491

(22) Filed: Jan. 18, 2019

(65) Prior Publication Data

US 2020/0232641 A1 Jul. 23, 2020

(51) Int. Cl.
*F23D 14/62* (2006.01)
*F23M 20/00* (2014.01)

(52) U.S. Cl.
CPC ..... *F23D 14/62* (2013.01); *F23M 20/005* (2015.01); *F23D 2210/00* (2013.01)

(58) Field of Classification Search
CPC ..... F23D 2210/00; F23D 14/62; F23M 20/005; F02M 35/02483; F02M 35/02416; F02M 35/0201; F02M 35/024; F02M 35/02433; F02M 35/048; F02M 35/162; F02M 35/0216; F02M 35/0245; F02M 35/0223; F02M 35/104; F02M 25/0854; F02M 35/0204; F02M 35/1001; F02M 35/10091; F02M 35/10386; F02M 25/0836; F02M 35/02425; F02M 35/042; F02M 35/10078; F02M 35/10157; F02M 35/10216; F02M 35/161; F02M 35/0202; F02M 35/0205; F02M 35/0215; F02M 35/02408; F02M 35/02491; F02M 35/044; F02M 35/084; F02M 35/086; F02M 35/10039; F02M 35/10144; F02M 35/10222;

(Continued)

(56) References Cited

U.S. PATENT DOCUMENTS

| | | | | |
|---|---|---|---|---|
| 4,087,234 | A | 5/1978 | Delyannis | |
| 4,318,688 | A * | 3/1982 | Buschulte | F23D 11/402 431/114 |
| 4,515,145 | A | 5/1985 | Tallman et al. | |
| 4,541,411 | A | 9/1985 | Woolf | |
| 4,561,421 | A | 12/1985 | Hwang et al. | |
| 4,900,245 | A | 2/1990 | Ahmady | |
| 5,311,930 | A | 5/1994 | Bruenn | |
| 5,893,358 | A | 4/1999 | Whitfield | |

(Continued)

FOREIGN PATENT DOCUMENTS

| | | | |
|---|---|---|---|
| DE | 69603389 | T2 | 4/2000 |
| EP | 1571398 | A2 | 9/2005 |
| EP | 2163820 | A1 | 3/2010 |

OTHER PUBLICATIONS

U.S. Appl. No. 15/723,340, filed Perez, et al.
U.S. Appl. No. 15/723,564, filed Perez, et al.
U.S. Appl. No. 15/723,284, filed Perez, et al.

*Primary Examiner* — Jason Lau
(74) *Attorney, Agent, or Firm* — Shackelford, Bowen, McKinley & Norton, LLP

(57) ABSTRACT

An air intake coupling has at least one noise suppression hole formed therein. A gas-air mixer elbow is fluidly coupled to the air intake coupling. A burner box assembly is fluidly coupled to the gas-air mixer elbow via a gas-air plenum box. A heat-exchange tube has a first end that is fluidly coupled to the burner box assembly. A fan is fluidly coupled to a second end of the heat-exchange tube via a cold-end header box.

20 Claims, 5 Drawing Sheets

(58) Field of Classification Search
CPC ..... F02M 35/10249; F02M 35/10268; F02M 35/1038; F02M 17/34; F02M 17/38; F02M 25/0222; F02M 25/025; F02M 25/028; F02M 25/0818; F02M 25/10; F02M 26/01; F02M 26/04; F02M 26/05; F02M 26/06; F02M 26/10; F02M 26/15; F02M 26/16; F02M 26/22; F02M 26/24; F02M 26/34; F02M 26/35; F02M 26/48; F02M 26/71; F02M 2700/05; F02M 31/042; F02M 35/02; F02M 35/0203; F02M 35/0209; F02M 35/021; F02M 35/0212; F02M 35/0214; F02M 35/0218; F02M 35/02441; F02M 35/02458; F02M 35/02466; F02M 35/04; F02M 35/08; F02M 35/09; F02M 35/10; F02M 35/10019; F02M 35/10045; F02M 35/10052; F02M 35/10124; F02M 35/1017; F02M 35/10242; F02M 35/10262; F02M 35/10281; F02M 35/10288; F02M 35/10393; F02M 35/1205; F02M 35/1261; F02M 35/1272; F02M 35/1288; F02M 35/164; F02M 69/043; F02M 7/12
See application file for complete search history.

(56) References Cited

U.S. PATENT DOCUMENTS

| | | | | |
|---|---|---|---|---|
| 6,129,628 | A | 10/2000 | O'Hagin et al. | |
| 6,238,206 | B1 * | 5/2001 | Cummings, III | F23D 14/24 431/10 |
| 9,772,119 | B2 | 9/2017 | Shellenberger et al. | |
| 10,281,143 | B2 | 5/2019 | Batson et al. | |
| 2004/0068970 | A1 * | 4/2004 | Hasegawa | F02M 35/024 55/498 |
| 2005/0048430 | A1 | 3/2005 | Steiner | |
| 2005/0076621 | A1 * | 4/2005 | Chang | F02M 35/024 55/320 |
| 2008/0314378 | A1 | 12/2008 | Khan et al. | |
| 2009/0098496 | A1 | 4/2009 | Poirier | |
| 2010/0310998 | A1 | 12/2010 | Raleigh et al. | |
| 2012/0024281 | A1 | 2/2012 | Lyons et al. | |
| 2013/0277144 | A1 * | 10/2013 | Tange | F02M 35/1266 181/229 |
| 2014/0011143 | A1 | 1/2014 | Barozzi et al. | |
| 2014/0174426 | A1 | 6/2014 | Moon et al. | |
| 2015/0184850 | A1 | 7/2015 | Seeley | |
| 2015/0192291 | A1 | 7/2015 | Akbarimonfared et al. | |
| 2016/0102888 | A1 | 4/2016 | Kuckelkorn et al. | |
| 2017/0241666 | A1 | 8/2017 | Kowald | |
| 2018/0202652 | A1 | 7/2018 | Batson et al. | |
| 2018/0259179 | A1 | 9/2018 | Kowald et al. | |
| 2021/0088211 | A1 | 3/2021 | Daddis et al. | |

* cited by examiner

AIR INTAKE COUPLING WITH NOISE SUPPRESSION FOR LOW NOX EMISSION FURNACE

CROSS REFERENCE TO RELATED APPLICATIONS

This patent application incorporates by reference for any purpose the entire disclosure of U.S. patent application Ser. No. 15/723,284, filed on Oct. 3, 2017; U.S. patent application Ser. No. 15/723,340, filed on Oct. 3, 2017; and U.S. patent application Ser. No. 15/723,564, filed on Oct. 3, 2017.

TECHNICAL FIELD

The present disclosure relates generally to furnaces utilized with heating, air conditioning, and ventilation ("HVAC") equipment and more specifically, but not by way of limitation, to pre-mix furnace assemblies utilizing an intake coupling equipped with noise suppression in order to eliminate resonance during furnace operation.

BACKGROUND

This section provides background information to facilitate a better understanding of the various aspects of the disclosure. It should be understood that the statements in this section of this document are to be read in this light, and not as admissions of prior art.

Furnaces are common equipment in many commercial and residential HVAC systems. Operation of such furnaces typically includes the controlled combustion of a hydrocarbon fuel such as, for example, propane or natural gas, in the presence of atmospheric air. Theoretically, complete stoichiometric combustion of the hydrocarbon fuel yields carbon dioxide ($CO_2$), water vapor ($H_2O$). Nitrogen ($N_2$), and heat energy. In practice, however, complete stoichiometric combustion of the hydrocarbon fuel rarely occurs due to factors including, for example, combustion residence time and hydrocarbon fuel/air mixture ratio. Incomplete combustion of the hydrocarbon fuel yields combustion byproducts including, for example, carbon monoxide (CO) and various nitrous oxides (NOx). CO and NOx are generally regarded to be environmental pollutants and emissions of byproducts such as CO and NOx are commonly limited by federal, state, and local regulations. NOx, in particular, has recently been the subject of aggressive pollution-reducing agendas in many areas. As a result, manufacturers of furnaces and related HVAC equipment have undertaken efforts to reduce emission of NOx.

SUMMARY

Various aspects of the disclosure relate to a furnace. The furnace includes an air intake coupling. The air intake coupling has at least one noise suppression hole formed therein. A gas-air mixer elbow is fluidly coupled to the air intake coupling. A burner box assembly is fluidly coupled to the gas-air mixer elbow via a gas-air plenum box. A heat-exchange tube has a first end that is fluidly coupled to the burner box assembly. A fan is fluidly coupled to a second end of the heat-exchange tube via a cold-end header box.

Various aspects of the disclosure relate to an air intake coupling. The air intake coupling includes a first tubular section. A second tubular section is fluidly coupled to the first tubular section. A pressure tap is formed in the first tubular section. At least one noise suppression hole is formed in the second tubular section.

Various aspects of the disclosure relate to a method of manufacturing a furnace. The method includes forming a tubular air intake coupling and forming at least one noise suppression hole in the air intake coupling. The air intake coupling is fluidly coupled to a gas-air mixer elbow. The gas-air mixer elbow is fluidly coupled to a burner box assembly via a gas-air plenum box. A first end of a heat-exchange tube is fluidly coupled to the burner box assembly. A second end of the heat-exchange tube is fluidly coupled to a fan via a cold-end header box.

This summary is provided to introduce a selection of concepts that are further described below in the detailed description. This summary is not intended to identify key or essential features of the claimed subject matter, nor is it to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

During operation of a furnace, production of NOx is typically dependent upon factors including, for example, hydrocarbon fuel/air mixture ratio and residence time. In general, combustion of a lean hydrocarbon fuel/air mixture (e.g. greater than approximately 50% excess air) is desired. Additionally, a well-mixed hydrocarbon fuel/air mixture with a low residence time is desirable for low NOx production and emission. "Residence time" refers to a probability distribution function that describes the amount of time a fluid element could spend inside a chemical reactor such as, for example, a combustion chamber.

Most residential and commercial HVAC equipment utilize induced draft burners. Induced draft burners are characterized by an initial mixing of atmospheric air and the hydrocarbon fuel. This is typically accomplished by entraining the atmospheric air into the hydrocarbon fuel stream via, for example, a venturi or other similar device. Induced draft burners typically operate with a rich hydrocarbon fuel/air mixture and often exhibit a relatively large flame volume. The large flame volume increases combustion residence times, which allows further NOx production to occur. The excess air helps to cool off the products of combustion and spreads the combustion process over a larger area. The flame is typically drawn or induced in by a combustion air blower into a heat exchanger. Long combustion times lead to the creation of excess levels of NOx.

Another type of furnace utilizes a pre-mix burner. Pre-mix burners are fan powered, which allows the hydrocarbon fuel/air mixture ratio to be carefully controlled in an effort to prevent combustion with excess air. Pre-mix burners operate with a lean hydrocarbon fuel/air mixture and often exhibit short blue flames. Pre-mix burners exhibit short reaction zones and high burning velocities. This leads to short residence time and high combustion efficiency, which limits NOx production and emission.

Figure 1:
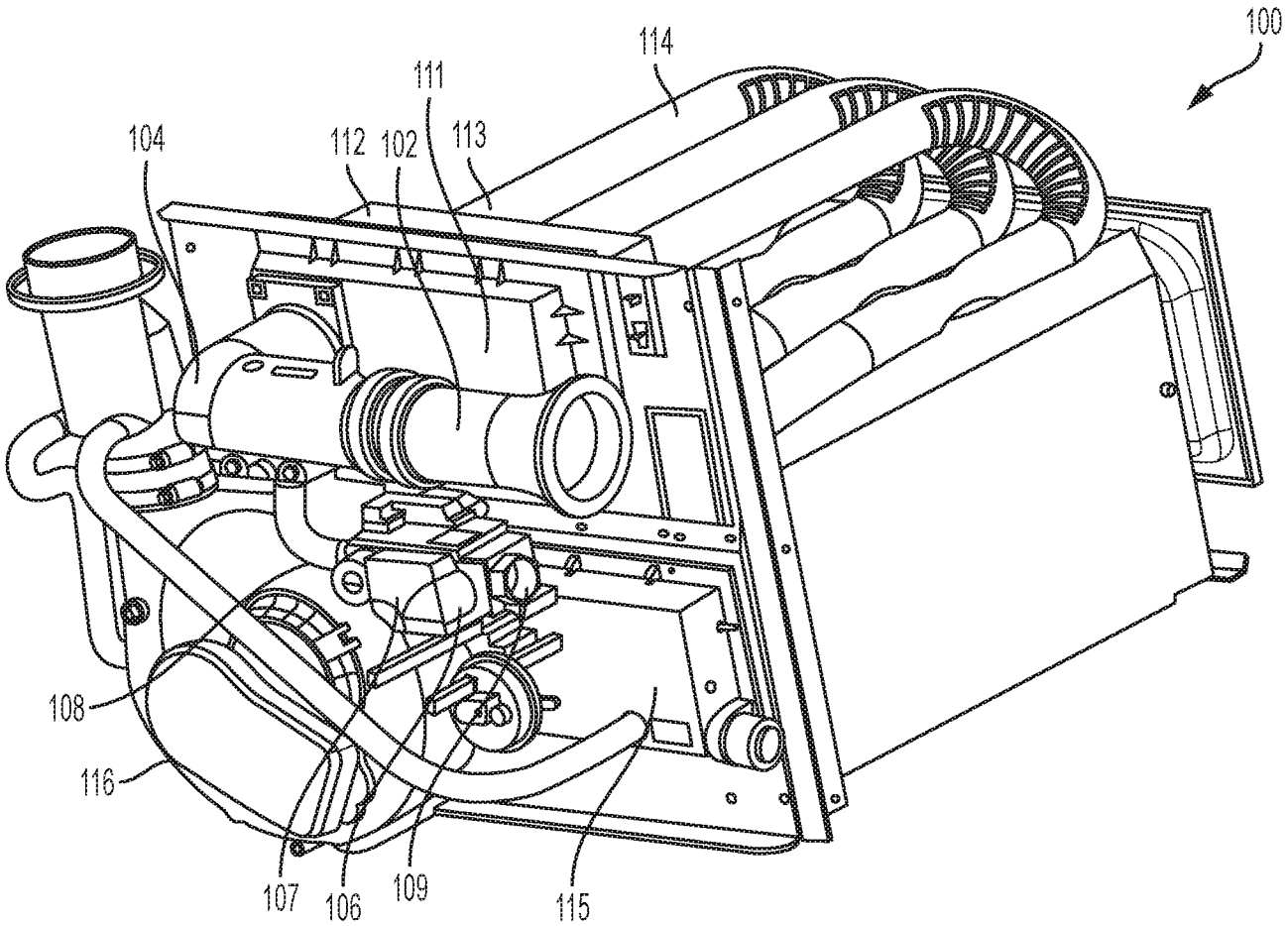
FIG. 1 is a perspective view of an illustrative furnace assembly implementing an air intake coupling in accordance with aspects of the disclosure.

FIG. 1 is a perspective view of a furnace assembly 100 implementing an air intake coupling 102 in accordance with aspects of the disclosure. The furnace assembly 100 includes the air intake coupling 102, which is fluidly coupled to a gas-air mixer elbow 104. A fuel valve 106 regulates a volume of hydrocarbon fuel that is supplied to a fuel tube 108. The fuel valve 106 is, for example, an electrically-actuated solenoid valve that opens or closes responsive to an electrical current being applied to a terminal 107 of the fuel valve 106. The fuel valve 106 includes a fuel inlet 109. The fuel inlet is fluidly coupled to, for example, a supply of a hydrocarbon fuel. The fuel tube 108 supplies the hydrocarbon fuel to the gas-air mixer elbow 104. In the gas-air mixer elbow 104, the hydrocarbon fuel mixes with atmospheric air supplied through the air intake coupling 102 to form a hydrocarbon fuel/air mixture. A fan 116 is fluidly coupled to a second end of a heat-exchange tube 114. The fan 116 is, for example a squirrel-cage blower; however, in other embodiments, other types of fans could be utilized.

Still referring to FIG. 1, a first end 113 of the heat-exchange tube 114 is fluidly coupled to a burner box assembly 112 that that has a pre-mix burner disposed therein. The burner box assembly 112 is fluidly coupled to a gas-air plenum box 111. The gas-air plenum box 111 is fluidly coupled to the gas-air mixer elbow 104. During operation, the fan 116 draws the hydrocarbon fuel/air mixture through the gas-air mixer elbow 104, through the gas-air plenum box 111, and through the burner box assembly 112 and the pre-mix burner. During operation, the fan 116 controls the mixture ratio of hydrocarbon fuel to atmospheric air to ensure that combustion in excess air is minimized. A low NOx premix combustion system, such as the furnace assembly 100, requires a gas-air linkage to maintain a consistent gas-air ratio. The air intake coupling 102 includes an orifice plate arranged in a coupling upstream of the gas-air mixer elbow 104. During operation, the pressure across the orifice plate is communicated to the fuel valve 106 through pressure tubing. The fuel valve 106 and a speed of the fan 116 are modulated according to the measured orifice pressure thereby maintaining the proper amount of excess air for combustion. In other embodiments, the pressure in the air intake coupling 102 could be measured electronically using, for example, a pressure transducer. Reducing combustion in excess air reduces production and emission of NOx. Igniters combust the hydrocarbon fuel/air mixture at the pre-mix burner. The igniters utilize a hot surface to combust the hydrocarbon fuel/air mixture; however, the igniters could utilize, for example, an electrical spark or a pilot flame to combust the hydrocarbon fuel/air mixture. The burner box assembly 112 is thermally exposed to the pre-mix burner and contains the combustion of the hydrocarbon fuel/air mixture. The fan 116 continues to draw hot combustion byproducts through the heat-exchange tube 114. In this manner, the furnace assembly 100 exhibits short combustion residence time when compared to induced draft burners, which contributes to low NOx production and emission. The combustion byproducts are exhausted to the exterior environment by the fan 116.

Figure 2:
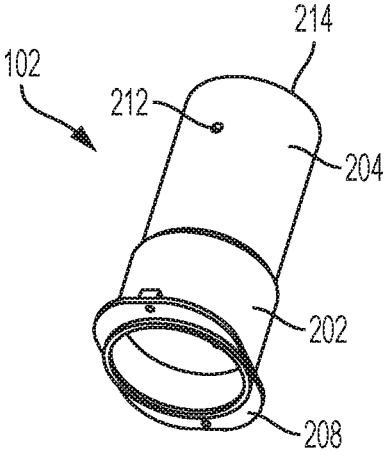
FIG. 2 is a perspective view of an air intake coupling in accordance with aspects of the disclosure.
Figure 3:
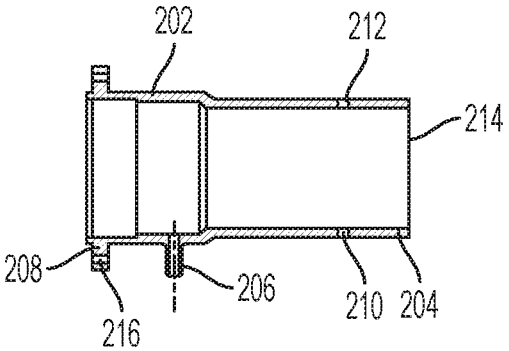
FIG. 3 is a cross-sectional view of an air intake coupling in accordance with aspects of the disclosure.
Figure 4:
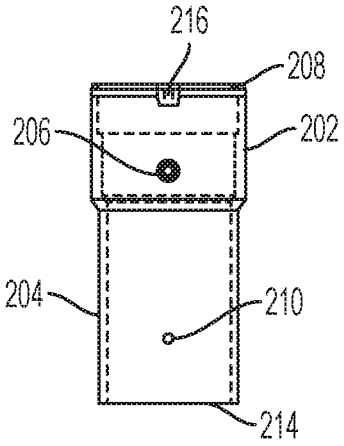
FIG. 4 is a side view of an air intake coupling in accordance with aspects of the disclosure.
Figure 5:
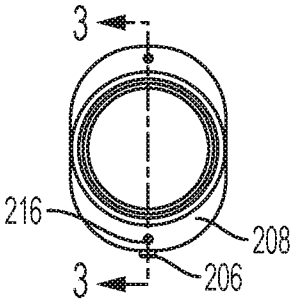
FIG. 5 is an end view of an air intake coupling in accordance with aspects of the disclosure.

FIG. 2 is a perspective view of the air intake coupling 102. FIG. 3 is a cross-sectional view of the air intake coupling 102. FIG. 4 is a side view of the air intake coupling. FIG. 5 is an end view of the air intake coupling 102. For purposes of discussion. FIGS. 2-5 are described herein relative to FIG. 1. Referring to FIGS. 2-5 collectively, the air intake coupling 102 includes a first section 202 and a second section 204. The first section 202 and the second section 204 have a tubular configuration and the first section 202 has a diameter that is slightly larger than a diameter of the second section 204. In various embodiments, the first section 202 and the second section 204 are integral; however in other embodiments, the first section 202 and the second section 204 may be formed separately and joined through any appropriate joining process. A pressure tap 206 is formed in the first section 202. In a typical embodiment, the pressure tap 206 is extruded from the first section 202 and facilitates connection of a pressure hose. A flange 208 is formed on an end of the first section 202 on a side opposite the second section 204. In operation, the flange facilitates assembly of the air intake coupling 102 to a fresh-air intake (not shown). In various embodiments, the air intake coupling 102 is coupled to a fresh-air intake, which may have a length in a range of six inches to 100 feet or more.

Still referring to FIGS. 2-5, a first noise suppression hole 210 and a second noise suppression hole 212 are formed in the second section 204. The first noise suppression hole 210 is formed on an opposite side of the second section 204 approximately 180 degrees from the second noise suppression hole 212 thereby allowing the first noise suppression hole 210 and the second noise suppression hole 212 to be formed, for example, via a single drilling operation. In other embodiments, however, the first noise suppression hole 210 and the second noise suppression hole 212 may be molded with the air intake coupling 102. In a typical embodiment, the first noise suppression hole 210 and the second noise suppression hole 212 are sized to ensure that less that approximately 8% of air drawn into the air intake coupling 102 leaks through the first noise suppression hole 210 and the second noise suppression hole 212. In various embodiments, the first noise suppression hole 210 and the second noise suppression hole 212 have a diameter of approximately 0.188 inches; however, in other embodiments, other sizes of the first noise suppression hole 210 and the second noise suppression hole 212 could be utilized provided that no more that approximately 8% of air drawn into the air intake coupling 102 leaks through the first noise suppression hole 210 and the second noise suppression hole 212.

Still referring to FIGS. 2-5, in various embodiments, the first noise suppression hole 210 and the second noise suppression hole 212 are located approximately 1.125 inches from an end 214 of the second section 204 opposite the connection to the first section 202; however, in other embodiments, the first noise suppression hole 210 and the second noise suppression hole 212 may be located at many positions on the second section 204. In various embodiments, the first noise suppression hole 210 is in line with the pressure tap 206 and a mounting hole 216 that is formed in the flange 208. Such alignment of the first noise suppression hole 210 with the pressure tap 206 facilitates alignment of the air intake coupling 102 for formation of the first noise suppression hole 210 and the second noise suppression hole 212. FIGS. 2-5 illustrate, by way of example, an embodiment utilizing the first noise suppression hole 210 and the second noise suppression hole 212; however, in other embodiments, any number of noise suppression holes could be utilized. Moreover, while the first noise suppression hole 210 and the second noise suppression hole 212 have been illustrated by way of example in FIGS. 2-5 as having a round shape, in various other embodiments, the first noise suppression hole 210 and the second noise suppression hole 212 may have any shape as necessary.

Figure 6:
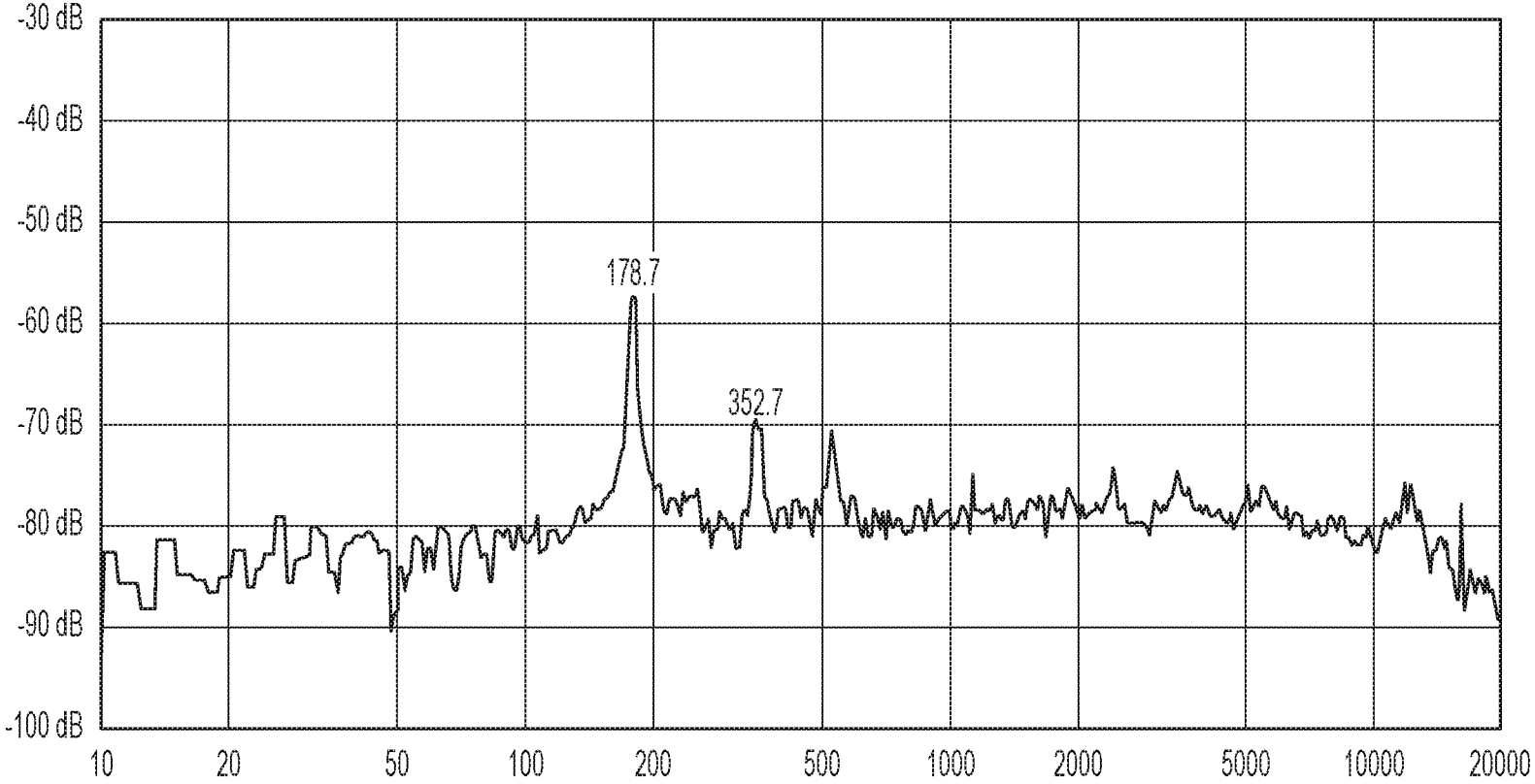
FIG. 6 is a plot of furnace noise without air intake noise suppression.
Figure 7:
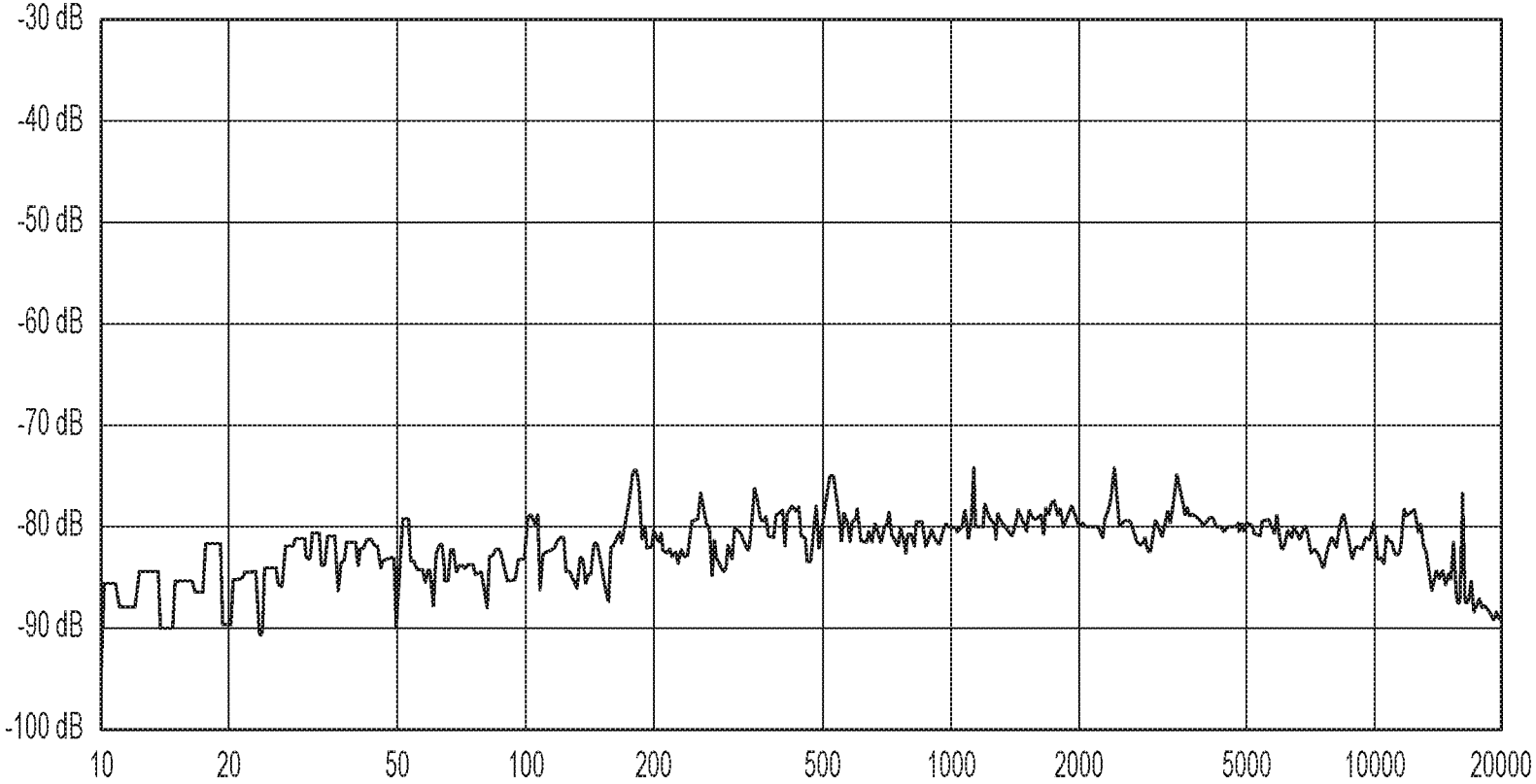
FIG. 7 is a plot of furnace noise with air intake noise suppression.

FIG. 6 is a plot of furnace noise without air intake noise suppression. FIG. 7 is a plot of furnace noise with air intake noise suppression. Referring to FIGS. 6-7 collectively, the first noise suppression hole 210 and the second noise suppression hole 212 reduce combustion-driven resonance of air moving through the air intake coupling 102, thereby reducing the "howl" often associated with furnaces such as the furnace assembly 100. In one embodiment, the first noise suppression hole 210 and the second noise suppression hole 212 reduces, for example, the 178 Hz and 352 Hz pure tones to inaudible levels.

Figure 8:
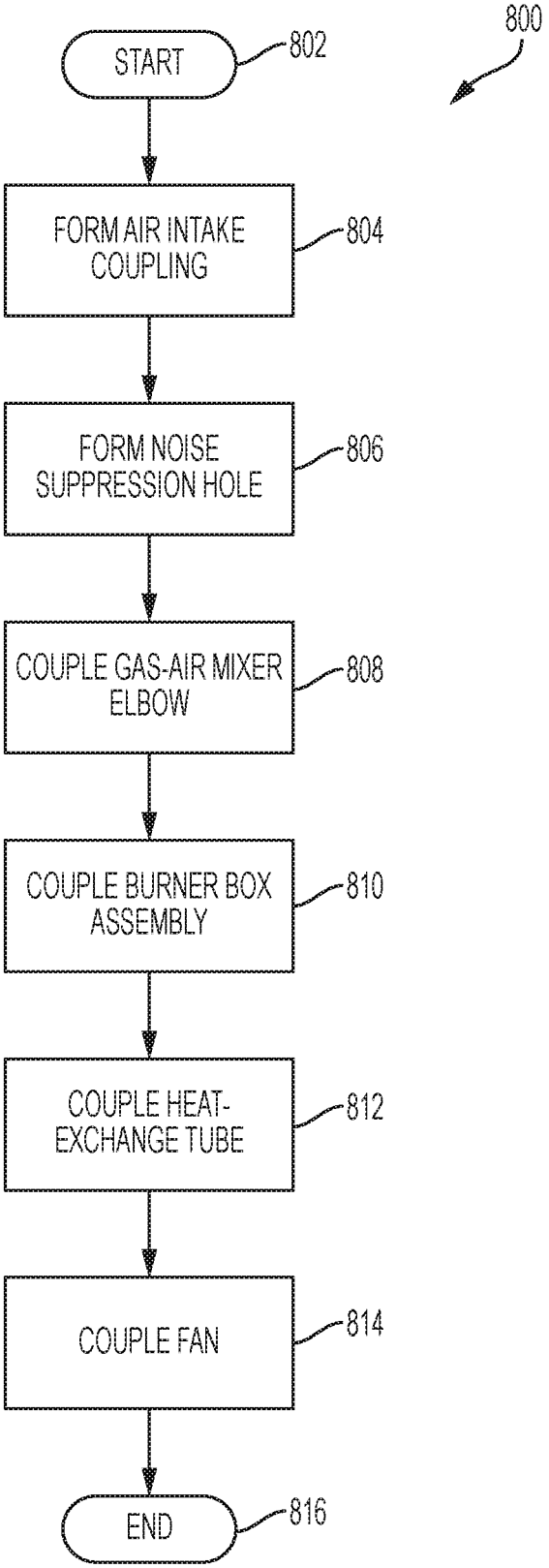
FIG. 8 is a flow diagram of a process for manufacturing a furnace according to aspects of the disclosure.

FIG. 8 is a flow diagram of a process 800 for manufacturing a furnace. For purposes of discussion, FIG. 8 is described herein relative to FIGS. 1-5. The process 800 begins at step 802. At step 804 an air intake coupling 102 is formed. At step 806, at least one noise suppression hole (210, 212) is formed in the air intake coupling 102. At step 808, the air intake coupling 102 is fluidly coupled to a gas-air mixer elbow 104. At step 810, the gas-air mixer elbow 104 is fluidly coupled to the gas-air plenum box 111. The gas-air plenum box 111 is fluidly coupled to the burner box assembly 112. At step 812, the burner box assembly 112 is fluidly coupled to a first end of a heat-exchange tube 114. At step 814, a fan 116 is fluidly coupled to a cold-end header box 115. The cold-end header box 115 is fluidly coupled, directly or indirectly, to a second end of the heat-exchange tube 114. In a typical embodiment, a first noise suppression hole 210 and a second noise suppression hole 212 are formed in the air intake coupling 102. During operation, the first noise suppression hole 210 and the second noise suppression hole 212 reduce combustion-driven resonance of air moving through the air intake coupling 102 thereby reducing operational noise associated with the furnace assembly 100. The process 800 ends at step 816.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined by the language of the claims that follow. The term "comprising" within the claims is intended to mean "including at least" such that the recited list of elements in a claim are an open group. The terms "a," "an," and other singular terms are intended to include the plural forms thereof unless specifically excluded.

The invention claimed is:

1. A furnace comprising;

an air intake coupling, the air intake coupling having at least one noise suppression hole formed therein, the air intake coupling comprises a first tubular section and a second tubular section, wherein a diameter of the first tubular section is larger than a diameter of the second tubular section, wherein the first tubular section and the second tubular section each comprise a circular cross-section;

wherein the at least one noise suppression hole comprises a first noise suppression hole and a second noise suppression hole formed on opposite sides of the second tubular section;

a gas-air mixer elbow fluidly coupled to the air intake coupling;

a burner box assembly fluidly coupled to the gas-air mixer elbow via a gas-air plenum box;

a heat-exchange tube having a first end fluidly coupled to the burner box assembly;

a fan fluidly coupled to a second end of the heat-exchange tube via a cold-end header box; and a pressure tap formed in the first tubular section, wherein the first noise suppression hole is in line with the pressure tap.

2. The furnace of claim 1, wherein the first tubular section and the second tubular section are integral to each other.

3. The furnace of claim 1, wherein the at least one noise suppression hole comprises a plurality of noise suppression holes formed in the second tubular section.

4. The furnace of claim 3, wherein the first noise suppression hole is formed on opposite sides of the second tubular section approximately 180 degrees from the second noise suppression hole.

5. The furnace of claim 4, wherein the first noise suppression hole and the second noise suppression hole are formed via a single drilling operation.

6. The furnace of claim 1, wherein the at least one noise suppression hole prevents leakage of more than approximately 8% of air drawn into the air intake coupling.

7. The furnace of claim 1, wherein the at least one noise suppression hole comprises a diameter of approximately 0.188 inches.

8. The furnace of claim 1, comprising a flange formed on an end of the first tubular section on a side opposite the second tubular section.

9. A method of manufacturing a furnace, the method comprising:

forming a tubular air intake coupling, the air intake coupling comprises a first tubular section and a second tubular section, wherein a diameter of the first tubular section is larger than a diameter of the second tubular section, wherein the first tubular section and the second tubular section each comprise a circular cross-section;

forming at least one noise suppression hole in the air intake coupling, wherein the at least one noise suppression hole comprise a first noise suppression hole and a second noise suppression hole formed on opposite sides of the second tubular section;

forming a pressure tap in the first tubular section, wherein the first noise suppression hole is in line with the pressure tap;

fluidly coupling the air intake coupling to a gas-air mixer elbow;

fluidly coupling the gas-air mixer elbow to a burner box assembly via a gas-air plenum box;

fluidly coupling a first end of a heat-exchange tube to the burner box assembly; and fluidly coupling a second end of the heat-exchange tube to a fan via a cold-end header box.

10. The method of claim 9, wherein the first noise suppression hole is formed on opposite sides of the second tubular section approximately 180 degrees from the second noise suppression hole.

11. The method of claim 10, wherein the first noise suppression hole and the second noise suppression hole are formed via a single drilling operation.

12. The method of claim 10, wherein at least one of the first noise suppression hole and the second noise suppression hole is round.

13. A furnace comprising;

an air intake coupling, the air intake coupling having at least one noise suppression hole formed therein, the air intake coupling comprises a first tubular section and a second tubular section, wherein a diameter of the first tubular section is larger than a diameter of the second tubular section, wherein the first tubular section and the second tubular section each comprise a circular cross-section;

wherein the at least one noise suppression hole comprises a first noise suppression hole and a second noise suppression hole formed on opposite sides of the second tubular section;

a gas-air mixer elbow fluidly coupled to the air intake coupling;

a burner box assembly fluidly coupled to the gas-air mixer elbow via a gas-air plenum box;

a heat-exchange tube having a first end fluidly coupled to the burner box assembly;

a fan fluidly coupled to a second end of the heat-exchange tube via a cold-end header box; and a flange formed on an end of the first tubular section on a side opposite the second tubular section.

14. The furnace of claim 13, wherein the first tubular section and the second tubular section are integral to each other.

15. The furnace of claim 13, wherein the at least one noise suppression hole comprises a plurality of noise suppression holes formed in the second tubular section.

16. The furnace of claim 15, wherein the first noise suppression hole is formed on opposite sides of the second tubular section approximately 180 degrees from the second noise suppression hole.

17. The furnace of claim 16, wherein the first noise suppression hole and the second noise suppression hole are formed via a single drilling operation.

18. The furnace of claim 13, wherein the at least one noise suppression hole prevents leakage of more than approximately 8% of air drawn into the air intake coupling.

19. The furnace of claim 13, wherein the at least one noise suppression hole comprises a diameter of approximately 0.188 inches.

20. The furnace of claim 13, comprising a pressure tap formed in the first tubular section, wherein the first noise suppression hole is in line with the pressure tap.

* * * * *